US007009152B2

(12) United States Patent
Yu et al.

(10) Patent No.: US 7,009,152 B2
(45) Date of Patent: Mar. 7, 2006

(54) CONTROL DEVICE FOR ELECTRIC BLANKET

(76) Inventors: Link Yu, No. 90-94, Shang Ta, Shang Ta Village, Kuan Ying Hsiang, Taoyuan Hsien (TW); Ching-Fwu Suen, No. 83, Ta Chiao 5th Street, Yung Kang City, Tainan Hsien (CN)

( * ) Notice: Subject to any disclaimer, the term of this patent is extended or adjusted under 35 U.S.C. 154(b) by 0 days.

(21) Appl. No.: 10/888,686

(22) Filed: Jul. 8, 2004

(65) Prior Publication Data

US 2006/0006165 A1 Jan. 12, 2006

(51) Int. Cl.
*H05B 3/02* (2006.01)

(52) U.S. Cl. ..... 219/482; 219/490; 219/497

(58) Field of Classification Search ..... 219/482, 219/483, 488–490, 494, 497, 499, 501, 507; 323/239; 327/459, 476

See application file for complete search history.

(56) References Cited

U.S. PATENT DOCUMENTS 3,727,080 A * 4/1973 Hanchett ..... 327/459
4,277,671 A * 7/1981 Mori et al. ..... 219/497
4,441,069 A * 4/1984 Mendelson ..... 219/501

* cited by examiner

*Primary Examiner*—Tu Hoang
(74) *Attorney, Agent, or Firm*—Charles E. Baxley

(57) ABSTRACT

A control device for an electric blanket includes a voltage drop rectifier circuit connected to an AC power source, a control gate circuit, a zero-across detecting circuit connected to the AC power source, a central processing circuit connected to the zero-across detecting circuit, an activating circuit, and a button circuit. The control gate circuit includes a triac electrically connected in series to the AC power source. The activating circuit includes an input connected to the central processing unit and an output connected to the gate of the triac of the control gate circuit. The central processing circuit includes a central processor and outputs signals to control the activating circuit, the control gate circuit, and the heating element such that the heating element is activated when the zero-across detecting circuit detects that a voltage of the AC power source approximates zero and thus sends a signal to the central processing circuit.

7 Claims, 5 Drawing Sheets

CONTROL DEVICE FOR ELECTRIC BLANKET

BACKGROUND OF THE INVENTION

1. Field of the Invention

The present invention relates to a control device for an electric blanket.

2. Description of the Related Art

A typical electric blanket includes at least one heating element that generates heat energy for keeping the user's body warm. The electric blanket is electrically connected to an AC power source and includes a switch for activating the heating element. As illustrated in FIG. 4, the voltage and current from the AC power source are sine functions of time. Namely, the voltage of an AC power source of 60 Hz changes sixty (60) times per second as sine waves T1 having peak voltages at points a2 and a4. As illustrated in FIG. 5, when the switch is turned on, after a period of time "b" (i.e., on-time) corresponding to the peak voltage a2 has passed, the voltage applied to the heating element is suddenly increased from 0 to a2, resulting in noise signals and electromagnetic waves that are harmful to the user's body. Since the on-time of the electric blanket cannot be precisely controlled, the electromagnetic waves resulting from momentary voltage change would be a problem after a long-term use of the electric blanket.

SUMMARY OF THE INVENTION

An object of the present invention is to provide a control device for an electric blanket to prevent generation of electromagnetic waves when activating the electric blanket.

Another object of the present invention is to provide a control device for an electric blanket without using a transformer, thereby reducing the space occupied by the control device and providing an easy-to-carry electric blanket.

In accordance with a first aspect of the present invention, a control device for an electric blanket comprises a voltage drop rectifier circuit electrically connected to an AC power source, a control gate circuit, a zero-across detecting circuit electrically connected to the AC power source, a central processing circuit connected to the zero-across detecting circuit, an activating circuit, and a button circuit connected to the central processing unit.

The control gate circuit includes a triac electrically connected in series to the AC power source. The triac is connected to a heating element and includes a gate. The zero-across detecting circuit sends a signal to the central processing circuit when a voltage of the AC power source approximates zero. The activating circuit includes an input connected to the central processing unit and an output connected to the gate of the triac of the control gate circuit. The central processing circuit includes a central processor and outputs signals to control the activating circuit, the control gate circuit, and the heating element such that the heating element is activated when the zero-across detecting circuit detects that a voltage of the AC power source approximates zero and thus sends a signal to the central processing circuit.

The zero-across detecting circuit includes a current limiting resistor with large impedance connected in series with the AC power source. The current limiting resistor is connected to a base of a NPN transistor. The NPN transistor includes a collector connected to the central processing circuit.

The activating circuit includes an amplifying circuit having an output connected to the gate of the triac of the control gate circuit.

The voltage drop rectifier circuit includes a resistor (R1) and a capacitor on an input side thereof for limiting current. The voltage drop rectifier circuit further includes four diodes and a Zener diode to form a bridge type voltage drop rectifier circuit. The voltage is fixed as 12V through the Zener diode. The voltage drop rectifier circuit further includes a filtering circuit including a forward diode and a reverse diode that are connected in parallel and two capacitors to generate a DC power source. The filtering circuit is further connected to a voltage-fixing circuit including a Zener diode, a resistor, a transistor, and two capacitors to generate a fixed voltage.

The control device may further include a liquid crystal display circuit for displaying time, temperature, etc. The control device may further include a voltage detecting circuit for detecting the voltages on two ends of the heating element. The control device may further include a current detecting circuit for detecting current passing through the heating element.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
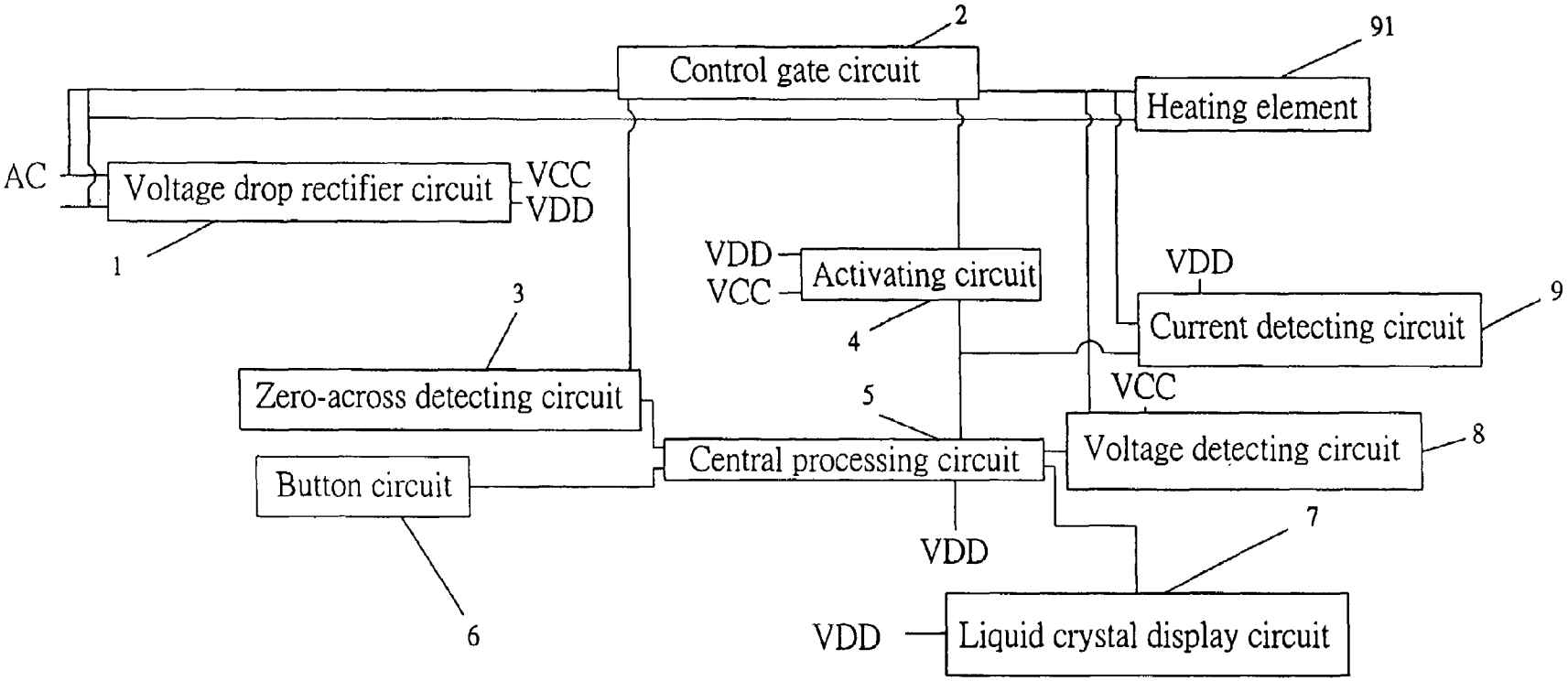
FIG. 1 is a schematic block diagram of a control device for an electric blanket in accordance with the present invention.

Referring to FIG. 1, a control device for an electric blanket in accordance with the present invention comprises a voltage drop rectifier circuit 1, a control gate circuit 2, a zero-across detecting circuit 3, an activating circuit 4, a central processing circuit 5, a button circuit 6, a liquid crystal display circuit 7, a voltage detecting circuit 8, and a current detecting circuit 9.

The voltage drop rectifier circuit 1 is electrically connected to an AC power source (100V–240V) and includes a resistor R1 and a capacitor C1 on an input side thereof for limiting the current. The voltage drop rectifier circuit 1 further includes four diodes D2, D3, D4, and D5 and a Zener diode D1 to form a bridge type voltage drop rectifier circuit. The voltage is fixed as 12V through use of the Zener diode D1. The voltage drop rectifier circuit 1 further includes a filtering circuit including a forward diode D6 and a reverse diode D7 that are connected in parallel and two capacitors C2 and C3 to generate a DC power source VCC. The filtering circuit is further connected to a voltage-fixing circuit including a Zener diode D8, a resistor R2, a transistor Q1, and two capacitors C4 and C5 to generate a fixed voltage VDD of 5V.

The control gate circuit 2 includes a TRIAC connected in series with the AC power source. The TRIAC is further connected to the heating element 91 and includes a gate connected to the activating circuit 4.

The zero-across detecting circuit 3 includes a current limiting resistor R3 with large impedance connected in series with the AC power source. The current limiting resistor R3 is connected to a base of a NPN transistor Q2. A collector of the NPN transistor Q2 is connected to the central processing circuit 5.

The activating circuit 4 includes an input connected to the central processing circuit 5. The activating circuit 4 further includes an amplifying circuit including three transistors Q3, Q4, and Q5 and seven transistors R4, R5, R6, R7, R8, R9, and RIO. Further, the amplifying circuit of the activating circuit 4 is connected to a light-emitting diode D9 and includes an output connected to the gate of the TRIAC of the control gate circuit 2.

The central processing circuit 5 includes a central processor U1 and connected to the zero-across detecting circuit 3, the activating circuit 4, the button circuit 6, the liquid crystal display circuit 7, the voltage detecting circuit 8, and the current detecting circuit 9. The central processing circuit 5 receives detecting signals from the zero-across detecting circuit 3 and outputs control signals to control the activating circuit 4, the control gate circuit 2, and the heating element 91.

The button circuit 6 includes switches for activation, setting time, etc. The liquid crystal display circuit 7 may display temperature, time, etc. The voltage detecting circuit 8 detects the voltages on two ends of the heating element 91. The current detecting circuit 9 detects the current passing through the heating element 91. When the heating element 91 is in a short circuit or open circuit, the voltage detecting circuit 8 and the current detecting circuit 9 may detect the abnormal state of the heating element 91, and the central processor U1 cuts off the power supply to the heating element 91, providing improved safety.

Figure 2:
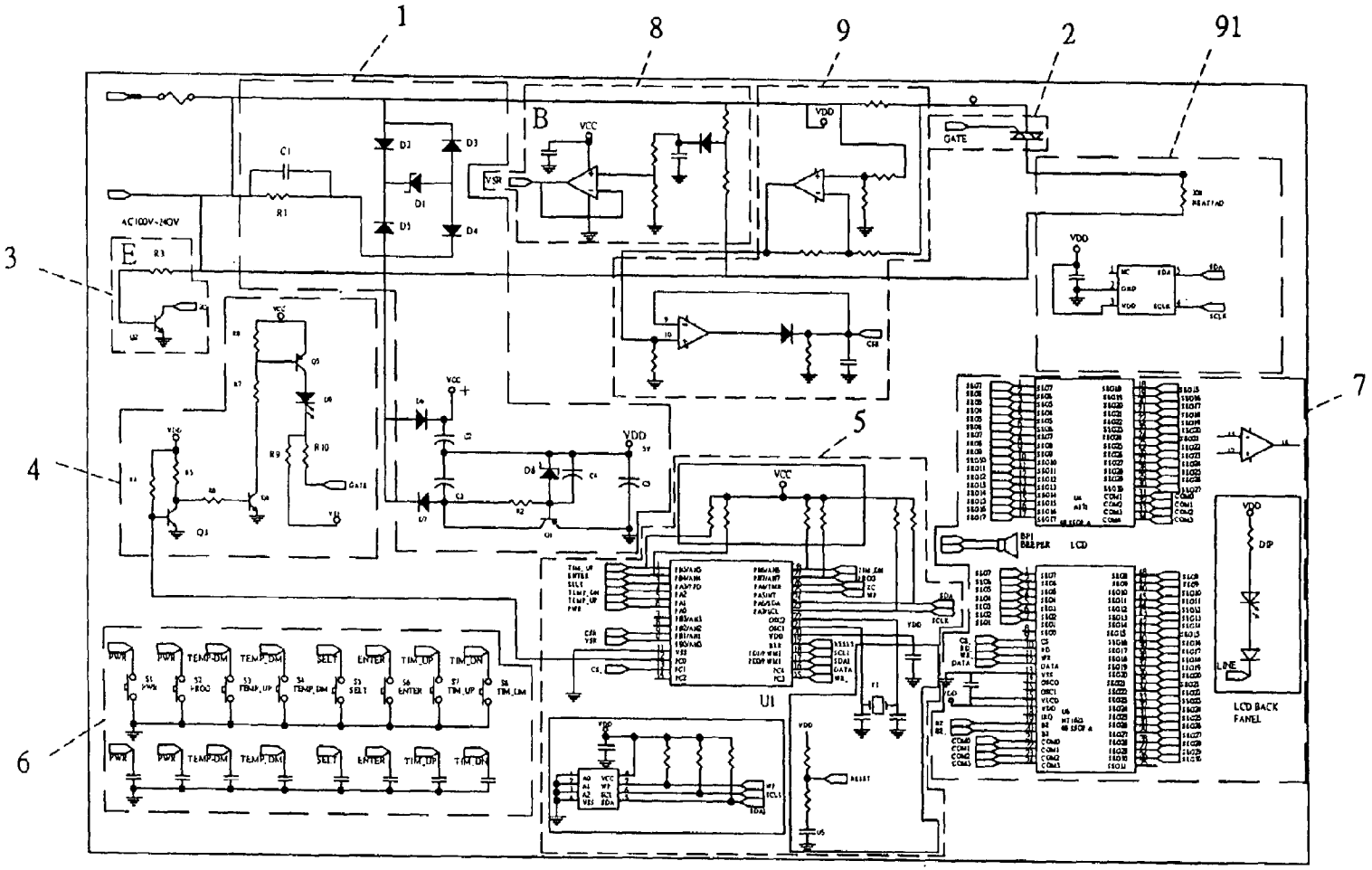
FIG. 2 is a circuitry of the control device for an electric blanket in accordance with the present invention.
Figure 3:
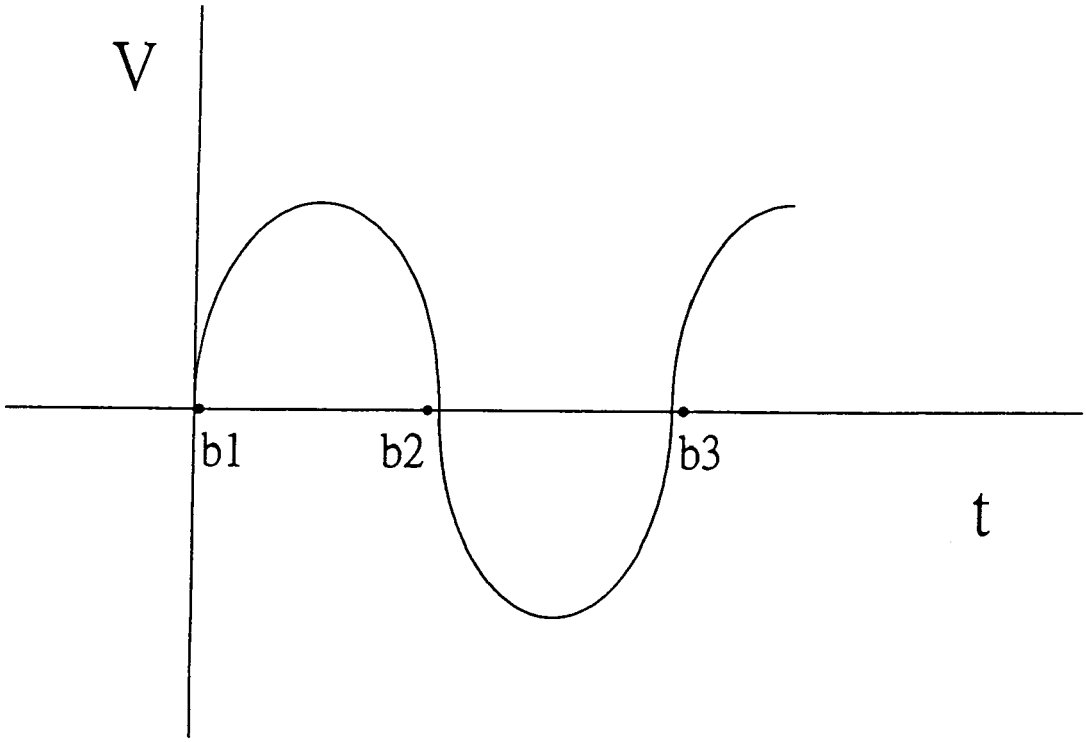
FIG. 3 is a voltage diagram of an AC power source connected to the electric blanket in accordance with the present invention.
Figure 4:
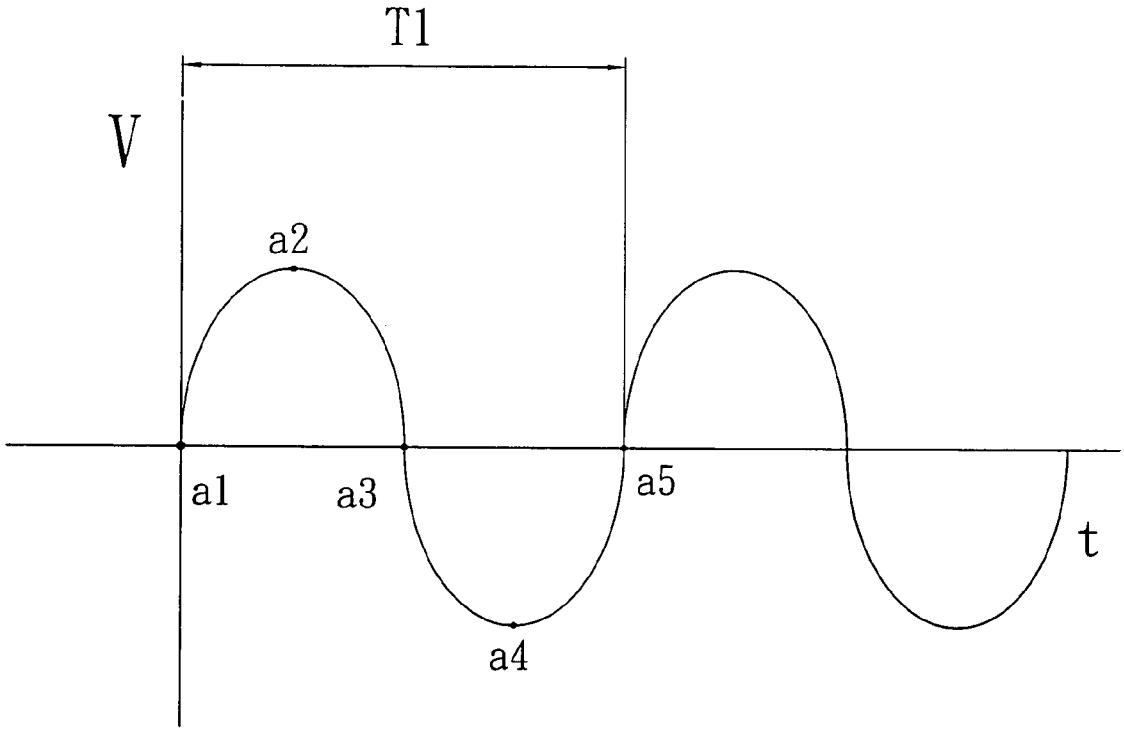
F I G . 4 (PRIOR ART)
FIG. 4 is a voltage time diagram of an AC power source.
Figure 5:
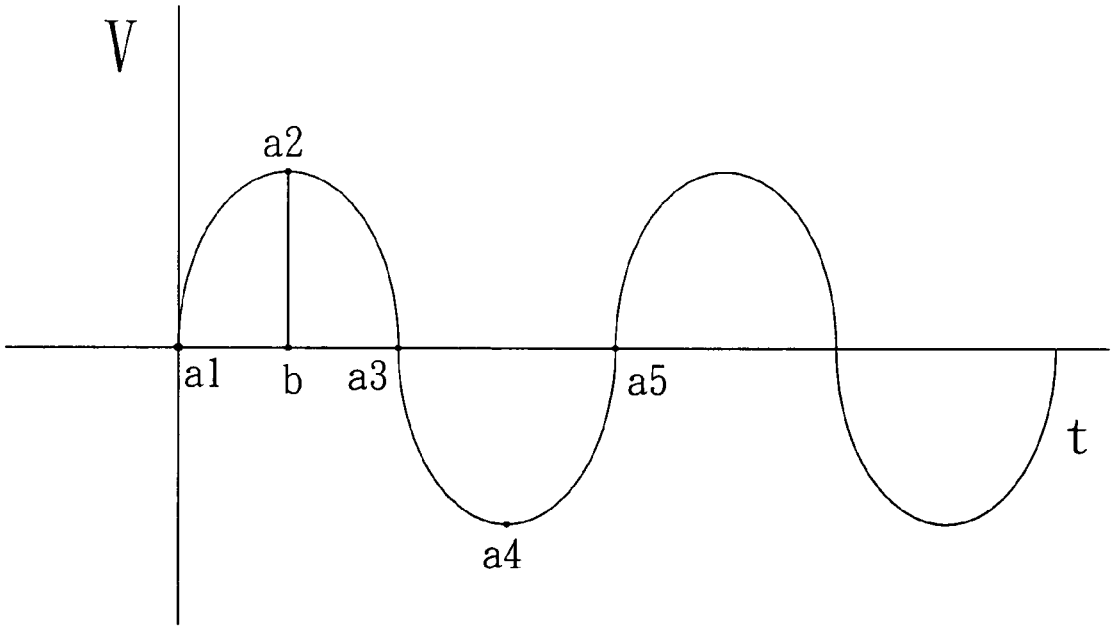
F I G . 5 (PRIOR ART)
FIG. 5 is a diagram similar to FIG. 4, illustrating momentary voltage change of the AC power source.

Referring to FIGS. 1 through 3, when the control device in accordance with the present invention is connected to an AC power source, the voltage drop rectifier circuit 1 is activated to generate DC power sources VCC and VDD. When an activating switch of the button circuit 6 is turned on, the central processor U1 receives a signal relating to turning on of the activating switch and awaits a detecting signal from the zero-across detecting circuit 3. In a case that the zero-across detecting circuit 3 detects that the voltage of the AC power source rises from a low voltage to 0.6 V that approximates zero, the transistor Q2 changes from a non-conductive state to a conductive state and the collector of the transistor Q2 changes from a high potential to a low potential. On the other hand, if the zero-across detecting circuit 3 detects that the voltage of the AC power source drops from a high voltage to a value smaller than 0.6 V that approximates zero, the transistor Q2 changes from the conductive state to the non-conductive state and the collector of the transistor Q2 changes from a low potential to a high potential. The central processor U1 receives a signal relating to the potential change (see b1, b2, b3 in FIG. 3) and outputs a signal to activate the activating circuit 4. The activating circuit 4 outputs a high voltage to turn on the triac of the gate control circuit 2 and the AC current is applied to the heating element 91 to generate heat energy. Thus, the heating element 91 is activated when the corresponding voltage of the AC power source approximates the zero. This avoids generation of electromagnetic waves resulting from momentary voltage change.

Thus, the control device for an electric blanket in accordance with the present invention may prevent generation of electromagnetic waves when activating the electric blanket and thus prevent harm to the user. Further, transformer is not required in an electric blanket with a control device in accordance with the present invention. The space occupied by the control device and the weight of the control device are both reduced, providing an easy-to-carry electric blanket.

Although specific embodiments have been illustrated and described, numerous modifications and variations are still possible without departing from the essence of the invention. The scope of the invention is limited by the accompanying claims.

What is claimed is:

1. A control device for an electric blanket, comprising:

a voltage drop rectifier circuit (1) electrically connected to an AC power source;

a control gate circuit (2) including a triac electrically connected in series to the AC power source, the triac being connected to a heating element (91) and including a gate;

a zero-across detecting circuit (3) electrically connected to the AC power source;

a central processing circuit (5) connected to the zero-across detecting circuit (3), the zero-across detecting circuit (3) sending a signal to the central processing circuit (5) when a voltage of the AC power source approximates zero;

an activating circuit (4) including an input connected to the central processing unit (5), the activating circuit further including an output connected to the gate of the triac of the control gate circuit (2); and a button circuit (6) connected to the central processing unit (5), the central processing circuit (5) including a central processor (U1) and outputting signals to control the activating circuit (4), the control gate circuit (2), and the heating element (91) such that the heating element (91) is activated when the zero-across detecting circuit (3) detects that a voltage of the AC power source approximates zero and thus sends a signal to the central processing circuit (5).

2. The control device for an electric blanket as claimed in claim 1, with the zero-across detecting circuit (3) including a current limiting resistor (R3) with large impedance connected in series with the AC power source, the current limiting resistor (R3) being connected to a base of a NPN transistor (Q2), the NPN transistor (Q2) including a collector connected to the central processing circuit (5).

3. The control device for an electric blanket as claimed in claim 1, with the activating circuit (4) including an amplifying circuit having an output connected to the gate of the triac of the control gate circuit (2).

4. The control device for an electric blanket as claimed in claim 1, with voltage drop rectifier circuit (1) including a resistor (R1) and a capacitor (C1) on an input side thereof for limiting current, the voltage drop rectifier circuit (1) further including four diodes (D2, D3, D4, and D5) and a Zener diode (D1) to form a bridge type voltage drop rectifier circuit, the voltage being fixed as 12V through the Zener diode (D1), the voltage drop rectifier circuit further including a filtering circuit including a forward diode (D6) and a reverse diode (D7) that are connected in parallel and two capacitors (C2 and C3) to generate a DC power source (VCC), the filtering circuit being further connected to a voltage-fixing circuit including a Zener diode (D8), a resis tor (R2), a transistor (Q1), and two capacitors (C4 and C5) to generate a fixed voltage (VDD).

5. The control device for an electric blanket as claimed in claim 1, with the control device further including a liquid crystal display circuit (7).

6. The control device for an electric blanket as claimed in claim 1, with the control device further including a voltage detecting circuit (8) for detecting the voltages on two ends of the heating element (91).

7. The control device for an electric blanket as claimed in claim 1, with the control device further including a current detecting circuit (9) for detecting current passing through the heating element (9).

* * * * *

UNITED STATES PATENT AND TRADEMARK OFFICE

CERTIFICATE OF CORRECTION

PATENT NO. : 7,009,152 B2
APPLICATION NO. : 10/888686
DATED : March 7, 2006
INVENTOR(S) : Link Yu and Ching-Fwu Suen It is certified that error appears in the above-identified patent and that said Letters Patent is hereby corrected as shown below:

On Title Page, Item (76) col. 1 should read,
Inventors: Link Yu. No. 90-94, Shang Ta, Shang Ta Village, Kuan Ying Hsiang, Taoyuan Hsien (TW); Ching-Fwu Suen, No. 83, Ta Chiao 5th Street, Yung Kang City, Tainan Hsien (TW)

Signed and Sealed this

Fifth Day of September, 2006

JON W. DUDAS
*Director of the United States Patent and Trademark Office*